US005299922A

United States Patent [19]

Moody

[11] Patent Number: 5,299,922

[45] Date of Patent: Apr. 5, 1994

[54] POSITIVE DISPLACEMENT ROTARY PUMP

[75] Inventor: Paul E. Moody, Barrington, R.I.

[73] Assignee: The United States of America as represented by the Secretary of the Navy, Washington, D.C.

[21] Appl. No.: 983,951

[22] Filed: Dec. 1, 1992

[51] Int. Cl.[5] ..... F01C 5/00

[52] U.S. Cl. ..... 418/45; 418/5; 417/476

[58] Field of Search ..... 418/45, 5, 153; 417/320, 474, 476

[56] References Cited

U.S. PATENT DOCUMENTS 2,585,949 2/1952 MacCormack ..... 417/476
3,111,260 11/1963 Brymer ..... 418/5
3,829,256 8/1974 Güttinger ..... 418/5
3,837,433 9/1974 Combs, Jr. et al. ..... 417/476

FOREIGN PATENT DOCUMENTS 1176912 8/1984 Canada ..... 418/45
0008489 1/1985 Japan ..... 418/45

*Primary Examiner*—Richard A. Bertsch
*Assistant Examiner*—Charles G. Freay
*Attorney, Agent, or Firm*—Michael J. McGowan; Prithvi C. Lall; Michael F. Oglo

[57] ABSTRACT

An eccentric drive rotates inside a ring that is hinged to a plate and an elastomeric curtain is wrapped around the ring and across an articulated plate. The curtain moves along a cylindrical wall inside the pump cavity to move fluid from an inlet to an outlet end of the chamber. Two or more chambers can be coupled in series or in parallel with one another.

5 Claims, 2 Drawing Sheets

POSITIVE DISPLACEMENT ROTARY PUMP

STATEMENT OF GOVERNMENT INTEREST

The invention described herein may be manufactured and used by or for the Government of the U.S. of America for Governmental purposes without the payment of any royalties thereon or therefor.

BACKGROUND OF THE INVENTION (1) Field of the Invention

This invention relates generally to rotary type positive displacement pumps, and deals more particularly with a positive displacement rotary pump for achieving high flow rates of incompressible fluids in an underwater environment where a vehicle's acoustical noise must be kept to a minimum.

(2) Description of the Prior Art

In a shipboard environment where torpedoes are to be launched by either a positive displacement ram-type piston, or by a rotary pump system difficulties have been encountered with such prior art systems chiefly for two reasons, first due to the acoustical noise created, and secondly due to the space requirements for such systems generally.

In a ram-type piston system the volume of water to be pumped must be approximately equal to the volume of the weapon which is to be launched. This problem of volume is magnified by the fact that the water piston is powered by an in-line air piston, effectively doubling the length of the overall ejection system required. In addition, as the piston completes its stroke, it must be stopped or decelerated without generating excessive noise. The piston must then be returned to its ready position before a second launch can be achieved.

These factors have led to the development of a rotary impeller pump system to replace the so-called ram or piston-type system. An air turbine has been used to drive the impeller so as to pump seawater behind the weapon to effect its launch. Such a system is considerably smaller than the ram or piston-type system and does permit a gradual deceleration of the pump at the end of the power stroke and does not require any return to a ready position. However, one difficulty with a turbine driven impeller pump launching system can be attributed to the fact that the pump will never reach steady state operation as the weapon will have been launched before the pump reaches this condition. Torpedo tube-weapon exit velocity requirements dictate that the weapon be launched in less than one second.

The development of a quiet system with a pump of the impeller type that will not cavitate while in a start-up or transient mode of operation has encountered problems. Excessive noise has been generated in impeller-type pump systems due to cavitation. Large diameter pumps rotating relatively slowly have been proposed, but the size requirements are such that there is a need for a more efficient and cost effective pumping system to launch weapons from underwater vehicles.

SUMMARY OF THE INVENTION

An object of the present invention is to provide a compact pumping system for use in a shipboard environment to hydraulically launch a torpedo.

Another object of the present invention is to provide an acoustically quiet pump capable of developing the high flow rates required for launching weapons within the short time available for this purpose.

Still another object of the present-invention is to provide a more efficient and cost effective pump for launching torpedoes than the systems currently available.

In a preferred embodiment of the present invention a positive displacement fluid pump is provided with a housing or case that defines two chambers, and inlet and outlet ports communicating with these chambers. The chambers are provided with a generally cylindrical wall, and a driven shaft is rotatably supported on an axis coincident with the axis of this cylindrical wall. A generally cylindrical rotor is mounted on the shaft on a rotor axis that is offset relative to the axis of the shaft so that the rotor follows a generally circular path around the shaft axis. An elastomeric curtain is secured to the housing and wrapped around the rotor such that the curtain is provided tangent to the cylindrical wall of the housing along a moving line of contact with the result that fluid admitted to the chamber through the inlet port is positively displaced toward the outlet port.

BRIEF DESCRIPTION OF THE DRAWING

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
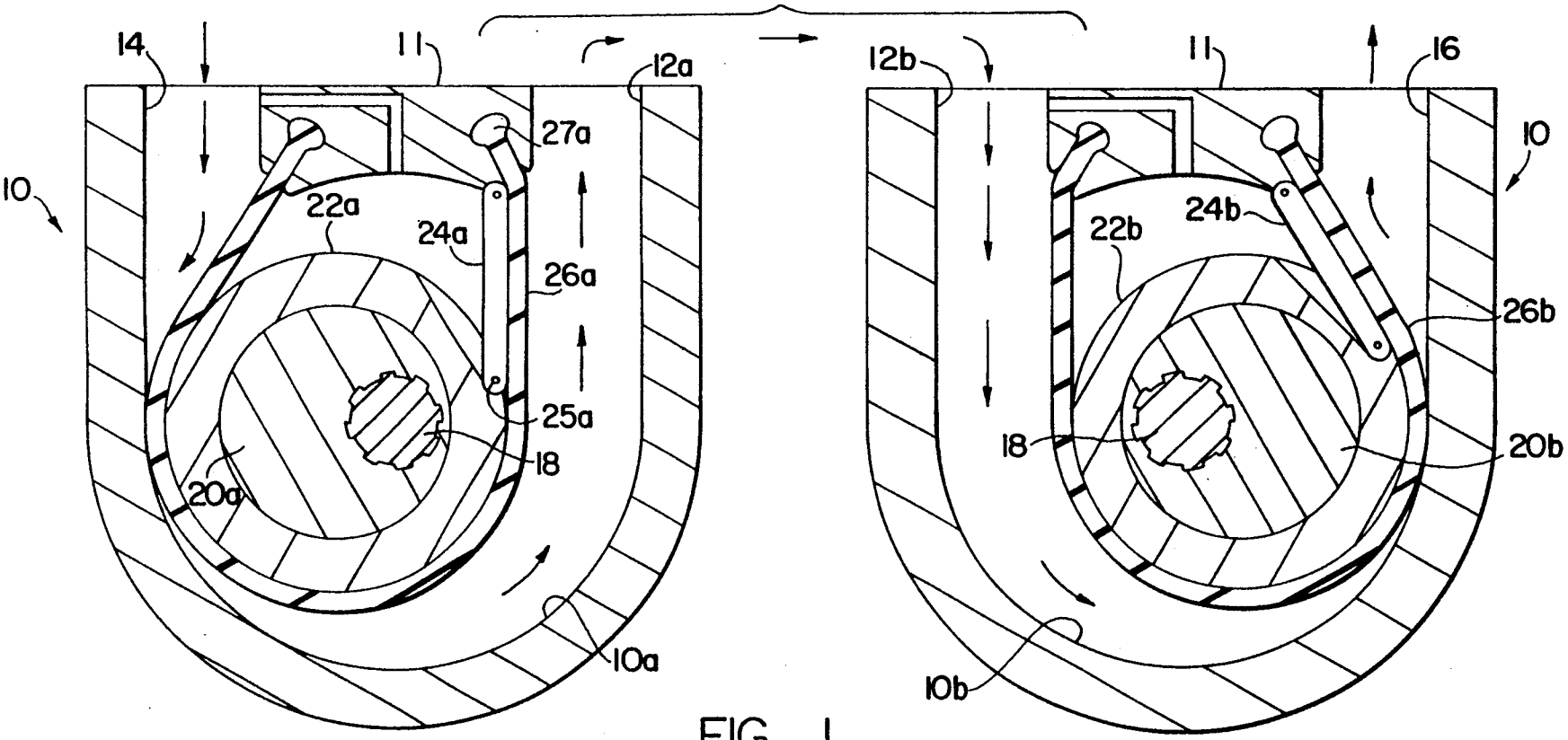
FIG. 1 shows in schematic fashion a two chamber version of a pump constructed in accordance with the present invention.
Figure 2:
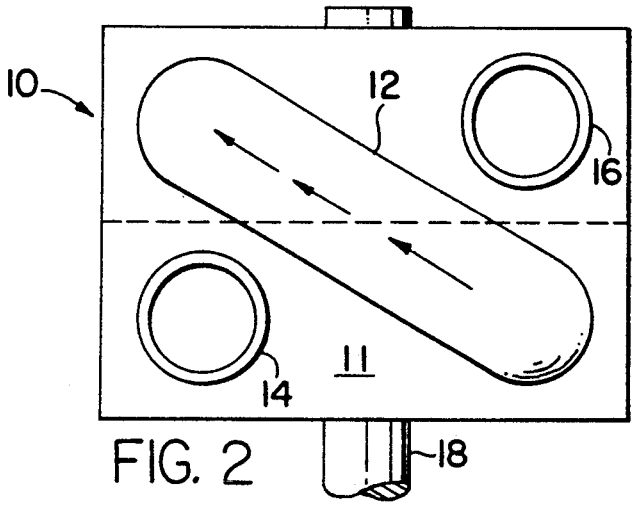
FIG. 2 is a top plan view of the pump illustrated in FIG. 1.

Turning now to the drawings in greater detail, FIG. 1 shows a housing 10 having a first chamber 10*a* and a second chamber 10*b*, which second chamber is identical to the first chamber and communicates with the first chamber by a conduit 12 as best shown in FIG. 2.

The housing 10 has an inlet port 14 through which seawater is admitted to the housing 10 and to the first chamber 10*a*. As indicated by the arrows in FIG. 1 seawater is provided under pressure through a port 12*a* to the conduit 12 mentioned previously and is directed into a port 12*b* associated with the second chamber 10*b*. As further indicated by the arrows in FIG. 1, the seawater is further pressurized so as to be exhausted through an outlet port 16 defined by the housing 10 at a desired pressure and flow rate associated with successful launch of the weapon from a torpedo tube or the like (not shown).

As mentioned previously, each of the two chambers 10*a* and 10*b* are identical, and referring now more specifically to the first chamber 10*a* it will be apparent that the housing 10 defines a generally cylindrical arcuate wall. At the center or axis of the cylindrical wall a drive shaft 18 is rotatably supported. The shaft 18 is splined to an eccentric drive element 20*a* which has a cylindrical external contour, and the center of the cylindrical contour for the eccentric 20*a* is offset from the center of rotation for the shaft 18. An annular compression ring 22*a* is provided for rotatably receiving the generally cylindrical eccentric drive element 20*a*. The compression ring 22*a* is held against rotation by an articulated guide plate 24a which guide plate has an upper marginal edge pivotally supported in the housing 10 and more particularly in a top wall 11 of the housing. The lower marginal edge of the plate 24a is pivotally provided in the compression ring 22a as indicated generally at 25a. As so configured the plate 24a affords a support for a segment of an elastomeric curtain 26a to prevent deformation and or deflection of the curtain as a result of the pressurized seawater moving upwardly through the outlet port 12a associated with the first chamber 10a.

The elastomeric curtain 26a has one marginal edge portion 27a supported in the top wall 11 of the housing 10, and this elastomeric curtain is wrapped around the cylindrical compression ring 22a in such a manner that the elastomeric curtain has its outer surface tangent to the cylindrical wall of the first chamber along a line of contact that is adapted to move as the rotor portion of the pump rotates through 180° from the position shown for it in the first chamber to a position similar to that depicted for the rotor in the second chamber of FIG. 1. The compression ring is held against rotation by the plate 24a and a rolling contact is achieved between the elastomeric curtain 26a and the wall of housing 10 of the first chamber so that this line of tangency moves from the 9 o'clock position shown for it in the left-hand portion of FIG. 1 to the 3 o'clock position shown for it in the second chamber of FIG. 1. As the eccentric drive 20a rotates within the compression ring 22a no fluid can slip between the curtain 26a and the housing 10. The fluid is forced through port 10a without any cavitation or noise, and with a minimum of frictional motion between the elastomeric curtain 26a and the housing 10.

While a two chamber pump is shown in the drawings it will be apparent that the advantages of the present invention can be realized with a single chamber if 180° of rotation provides enough flow to effectively launch a weapon or if an oscillating pressure pulse is acceptable. It will also be apparent that several such chambers can be connected either in parallel or in series with the result that a multi-stage pump can be adapted for purposes of providing seawater under high pressure to a torpedo tube for purposes of launching large weapons or for further smoothing of the final pressure pulse.

In the two-stage rotary pump illustrated in FIG. 1 the second chamber 10b is provided with its own inlet port 12b and the outlet port 16 referred to previously. A second elastomeric curtain 26b is provided with at least one marginal edge secured in the top 11 of the housing 10 and this elastomeric curtain is wrapped around the compression ring 22b in a manner similar to that shown for the elastomeric curtain 26a associated with the first chamber 10a.

The common drive shaft 18 is also splined to an eccentric drive element 20b which rotates at the same speed as the rotor in the first chamber. However the rotor in the second chamber is angularly displaced with respect to that of the first chamber by 180°. A backing or guide plate 24b is provided in the second chamber to prevent deformation of the elastomeric curtain all as described previously with respect to the first chamber.

As so constructed and arranged each chamber has a rotor, made up of an eccentric drive element splined to the driven shaft, and a non-rotating ring that is held in position by the backing plate and the eccentric drive element. The elastomeric curtain is wrapped at least partially around the rotor and has at least one end secured to the housing. While the other end of the curtain might be secured to the ring at a peripheral location spaced from the pivotal point of attachment for the plate, this curtain is preferably secured at both ends to the housing as shown. A passageway shall be provided to equalize the fluid pressure between the inlet port and the small space defined between the rotor and the top wall of the housing inside the elastomeric curtain (that is, in the space that is not utilized as an active part of the pump chamber). This passageway ports fluid back and forth from this space to ports 10a's or 10b's inlets so that the inlet end of the elastomeric curtains 26a and 26b are not stressed due to pressure inbalance across the curtains 26a and 26b inner and outer walls.

In light of the above, it is therefore understood that within the scope of the appended claims, the invention may be practices otherwise than as specifically described.

What is claimed is:

1. A fluid pump comprising:

a housing defining at least one chamber, and defining inlet and outlet ports communicating with said chamber, said chamber having an arcuate wall defined at least in part by a body of revolution;

a driven shaft rotatably supported on an axis that is fixed in said housing and located at the center of rotation defined by said arcuate wall;

a generally cylindrical rotor mounted on said shaft, said rotor having a central axis that is offset from the axis of said shaft;

an elastomeric curtain having one end secured to said housing and wrapped around said cylindrical rotor, said curtain providing a line of tangency between itself and said arcuate wall, said line of tangency providing a moving line of contact as said shaft rotates such that fluid admitted to said one chamber through said inlet port is positively displaced toward said outlet port;

said elastomeric curtain having a segment adjacent said line of tangency and adjacent the outlet port; and means supporting said segment of elastomeric curtain to accommodate for high pressure fluid at the outlet port.

2. The combination according to claim 1 wherein said rotor includes an annular compression ring, an eccentric drive element rotatably received inside said annular ring, said drive element secured to said shaft for rotation therewith.

3. The combination according to claim 1 wherein said housing further includes at least one additional chamber defined alongside said first chamber and wherein said second chamber also has; inlet and outlet ports, an arcuate wall, a rotor mounted to said driven shaft for rotation on an axis offset from its own axis, and wherein said second chamber further includes a second elastomeric curtain secured to said housing and wrapped around said second cylindrical rotor so as to provide a line of tangency between the elastomeric curtain and said arcuate wall; said second chamber having an inlet port communicating with the outlet port of said first chamber, and thereby providing a two-stage rotary pump assembly.

4. A fluid pump comprising:

a housing defining at least one chamber, and defining inlet and outlet ports communicating with said chamber, said chamber having an arcuate wall defined at least in part by a body of revolution;

a driven shaft rotatably supported on an axis that is fixed in said housing and located at the center of rotation defined by said arcuate wall;

a generally cylindrical rotor mounted on said shaft, said rotor having a central axis that is offset from the axis of said shaft;

an elastomeric curtain having one end secured to said housing and wrapped around said cylindrical rotor, said curtain providing a line of tangency between itself and said arcuate wall, said line of tangency providing a moving line of contact as said shaft rotates such that fluid admitted to said one chamber through said inlet port is positively displaced toward said outlet port;

said rotor including an annular compression ring, an eccentric drive element rotatably received inside said annular ring, said drive element secured to said shaft for rotation therewith; and a plate pivotally supported along one edge to said housing and having an opposite edge pivotally secured to said compression ring.

5. The combination according to claim 4 wherein said elastomeric curtain has an opposed marginal end, said opposite end secured to said housing and defining a space.

* * * * *